US008079120B2

(12) United States Patent
Luna et al.

(10) Patent No.: US 8,079,120 B2
(45) Date of Patent: Dec. 20, 2011

(54) METHOD FOR DETERMINING INITIAL BURNISHING PARAMETERS

(75) Inventors: Alberto Luna, Greenville, SC (US); Michael Jay Brunck, Cincinnati, OH (US)

(73) Assignee: General Electric Company, Schnectady, NY (US)

( * ) Notice: Subject to any disclaimer, the term of this patent is extended or adjusted under 35 U.S.C. 154(b) by 1190 days.

(21) Appl. No.: 11/618,755

(22) Filed: Dec. 30, 2006

(65) Prior Publication Data

US 2008/0160891 A1 Jul. 3, 2008

(51) Int. Cl.
*B21C 37/30* (2006.01)
*B24B 39/00* (2006.01)

(52) U.S. Cl. ..... 29/90.01; 29/407.01; 29/407.05; 29/407.08; 29/407.09; 29/90.3; 451/1; 451/28

(58) Field of Classification Search ..... 29/90.01–90.03, 29/407.01, 407.04, 407.05, 407.08, 407.09; 451/1, 28

See application file for complete search history.

(56) References Cited

U.S. PATENT DOCUMENTS

| | | | | |
|---|---|---|---|---|
| 2,393,317 | A | 1/1946 | Edwards, Jr. et al. | |
| 3,638,464 | A | 2/1972 | Winter et al. | |
| 3,690,140 | A | 9/1972 | Shive | |
| 3,695,091 | A | 10/1972 | Smith | |
| 3,950,642 | A | 4/1976 | Feld | |
| 4,347,689 | A * | 9/1982 | Hammond | 451/63 |
| 4,428,213 | A | 1/1984 | Neal et al. | |
| 4,470,292 | A | 9/1984 | DeClark et al. | |
| 4,839,245 | A | 6/1989 | Sue et al. | |
| 4,909,859 | A | 3/1990 | Nazmy et al. | |
| 4,974,434 | A | 12/1990 | Reccius et al. | |
| 5,421,939 | A * | 6/1995 | Scher et al. | 156/235 |
| 5,531,570 | A | 7/1996 | Mannava et al. | |
| 5,569,018 | A | 10/1996 | Mannava et al. | |
| 5,591,009 | A | 1/1997 | Mannava et al. | |
| 5,620,307 | A | 4/1997 | Mannava et al. | |
| 5,666,841 | A | 9/1997 | Seeger et al. | |
| 5,731,509 | A | 3/1998 | Thompson | |

(Continued)

FOREIGN PATENT DOCUMENTS

CA 2158761 2/2005

(Continued)

OTHER PUBLICATIONS

Prevey, Paul S., Hornbach, Douglas, Ravindranath, Ravi, Cammett, J.T., "Application of Low Plasticity Burnishing to Improve Damage Tolerance of a Ti-6A1-4V First Stage Fan Blade", Proceedngs 44th AIAA/ASME/ASCE/AHS Structures, Structural Dynamics & Materials Conf., Apr. 7-10, 2003, Lambda Technologies, Cincinnati, Ohio.

(Continued)

*Primary Examiner* — A. Dexter Tugbang
*Assistant Examiner* — Jeffrey T Carley
(74) *Attorney, Agent, or Firm* — David J. Clement, Esq.; Trego, Hines & Ladenheim, PLLC

(57) ABSTRACT

A method of determining parameters for a burnishing operation includes: using a rolling burnishing element to burnish at least two segments on a selected surface of a material sample, the segments having a common width and overlapping each other by a preselected overlap value; measuring the resulting hardness of the surface; and selecting a working overlap value for a subsequent burnishing operation on a workpiece, based on the measured hardness.

7 Claims, 2 Drawing Sheets

U.S. PATENT DOCUMENTS

| | | | | |
|---|---|---|---|---|
| 5,735,044 | A | 4/1998 | Ferrigno et al. | |
| 5,756,965 | A | 5/1998 | Mannava | |
| 5,771,729 | A | 6/1998 | Bailey et al. | |
| 5,826,453 | A * | 10/1998 | Prevey, III | 72/75 |
| 5,846,057 | A | 12/1998 | Ferrigno et al. | |
| 5,877,405 | A | 3/1999 | Champaigne | |
| 5,932,120 | A | 8/1999 | Mannava et al. | |
| 5,951,790 | A | 9/1999 | Mannava et al. | |
| 6,005,219 | A | 12/1999 | Rockstroh et al. | |
| 6,062,958 | A * | 5/2000 | Wright et al. | 451/288 |
| 6,144,012 | A | 11/2000 | Dulaney et al. | |
| 6,289,713 | B1 | 9/2001 | Champaigne | |
| 6,415,486 | B1 * | 7/2002 | Prevey, III | 29/90.01 |
| 6,483,578 | B1 | 11/2002 | Clauer et al. | |
| 6,568,239 | B1 | 5/2003 | Champaigne | |
| 6,592,435 | B2 * | 7/2003 | Kishima | 451/59 |
| 6,622,570 | B1 | 9/2003 | Prevey, III | |
| 6,672,838 | B1 | 1/2004 | Crall et al. | |
| 6,752,593 | B2 | 6/2004 | Clauer et al. | |
| 6,759,626 | B2 | 7/2004 | Clauer et al. | |
| 6,893,225 | B2 | 5/2005 | Crall et al. | |
| 6,959,572 | B2 | 11/2005 | Lawrence et al. | |
| 6,969,821 | B2 | 11/2005 | Mika et al. | |
| 7,185,521 | B2 | 3/2007 | Lombardo et al. | |
| 7,188,398 | B2 | 3/2007 | Prevey | |
| 7,229,253 | B2 | 6/2007 | Broderick et al. | |
| 7,261,500 | B2 | 8/2007 | Killer et al. | |
| 7,384,244 | B2 | 6/2008 | Broderick et al. | |
| 7,530,792 | B2 | 5/2009 | Luna et al. | |
| 7,600,404 | B2 | 10/2009 | Prevey, III | |
| 2001/0036800 | A1 * | 11/2001 | Liners et al. | 451/41 |
| 2005/0158460 | A1 | 7/2005 | Williams | |
| 2005/0171703 | A1 | 8/2005 | Goldfine et al. | |
| 2007/0175030 | A1 | 8/2007 | Luna et al. | |
| 2008/0011391 | A1 * | 1/2008 | Brenner et al. | 148/421 |

FOREIGN PATENT DOCUMENTS

| | | | |
|---|---|---|---|
| EP | 1 175 956 | A1 * | 1/2002 |
| EP | 1175956 | | 1/2002 |
| JP | 61060875 | | 3/1986 |
| WO | 9525821 | | 9/1995 |
| WO | 0164398 | | 9/2001 |
| WO | 2007055864 | | 5/2007 |

OTHER PUBLICATIONS

ASM International Handbook Committee, "ASM Handbook, vol. 4, Heat Treating", Aug. 1991, p. 607, ASM International, United States.

Prevey, P.S., Hornbach, D.J., Cammett, J.T., Ravindranath, R., "Damage Tolerance Improvement of Ti-6-4 Fan Blades with Low Plasticity Burnishing", 6th Joint FAA/DoD/NASA Aging Aircraft Conference, Sep. 16-19, 2002, pp. 1-9.

Prevey, Paul S., Telesman, Jack, Gabb, Timothy, Kantzos, Peter, "FOD Resistance and Fatigue Crack Arrest in Low Plasticity Burnish IN718", Proceedings: 5th National Turbine Engine High Cycle Fatigue Conference, Mar. 7-9, 2000, pp. 1-12, Lambda Technologies, Chandler, Arizona.

Ruschau, John J., John, Reji, Thompson, Steven R., Nicholas, Theodore, "Fatigue Crack Growth Rate Characteristics of Laser Shock Peened Ti-6A1-4V", "Journal of Engineering Materials and Technology", Jul. 1999, vol. 121, pp. 321-329, ASME.

Hammersley, Graham, Hackel, Lloyd A., Harris, Fritz, "Surface Pre-stressing to Improve Fatigue Strength of Components by Laser Shot Peening", "Optics and Lasers in Engineering", 2000, vol. 34, pp. 327-337, Elsevier Science Ltd.

* cited by examiner

METHOD FOR DETERMINING INITIAL BURNISHING PARAMETERS

BACKGROUND OF THE INVENTION

This invention relates generally to methods for creating fatigue-resistant and damage-tolerant components more specifically to a method of setting process parameters for a burnishing treatment.

Various metallic, ceramic, and composite components, such as gas turbine engine fan and compressor blades, are susceptible to cracking from fatigue and damage (e.g. from foreign object impacts). This damage reduces the life of the part, requiring repair or replacement. The main objective of burnishing is to impart residual stress onto a surface to obtain material benefits, like fatigue and corrosion resistance and preventing crack formation and propagation. Of these benefits the aerospace industry is most interested in increasing fatigue life stress resistance. It is known to protect components from crack propagation by inducing residual compressive stresses therein. Methods of imparting these stresses include shot peening, laser shock peening (LSP), pinch peening, and low plasticity burnishing (LPB). These methods are typically employed by applying a "patch" of residual compressive stresses over an area to be protected from crack propagation.

A typical burnishing apparatus includes rolling burnishing elements such as cylinders or spheres which are loaded against a workpiece at a selected burnishing pressure by mechanical or hydrostatic means, and traversed across the part surface in a series of strokes or segments. The magnitude of the residual stress is a function of a number of parameters, of which the most influential are the burnishing pressure and the degree of overlap of burnishing strokes. With the high costs of fatigue testing, the initial selection of these parameters can prove expensive given the broad range of burnishing pressures and degrees of overlap.

In the prior art, initial pressure and overlap selection is performed either arbitrarily or through trial and error. A trial and error approach is not only expensive but time consuming.

Furthermore, using parameters derived for a particular application may not have the same results for another application. For example, burnishing two thin plates of the same material under the same conditions but with different cross-sectional thickness will result in different degrees of overlap up to a critical thickness, and therefore will behave differently in fatigue testing. The critical thickness is the thickness for a given material at which the degree of overlap will remain constant at or above this value, if all other parameters are held constant.

BRIEF SUMMARY OF THE INVENTION

The above-mentioned shortcomings in the prior art among others are addressed by the present invention, which according to one embodiment provides a method of determining parameters for a burnishing operation, including: using a rolling burnishing element to burnish at least two segments on a selected surface of a material sample, the segments having a common width and overlapping each other by a preselected overlap value; measuring the resulting hardness of the surface; and selecting a working overlap value for a subsequent burnishing operation on a workpiece, based on the measured hardness.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
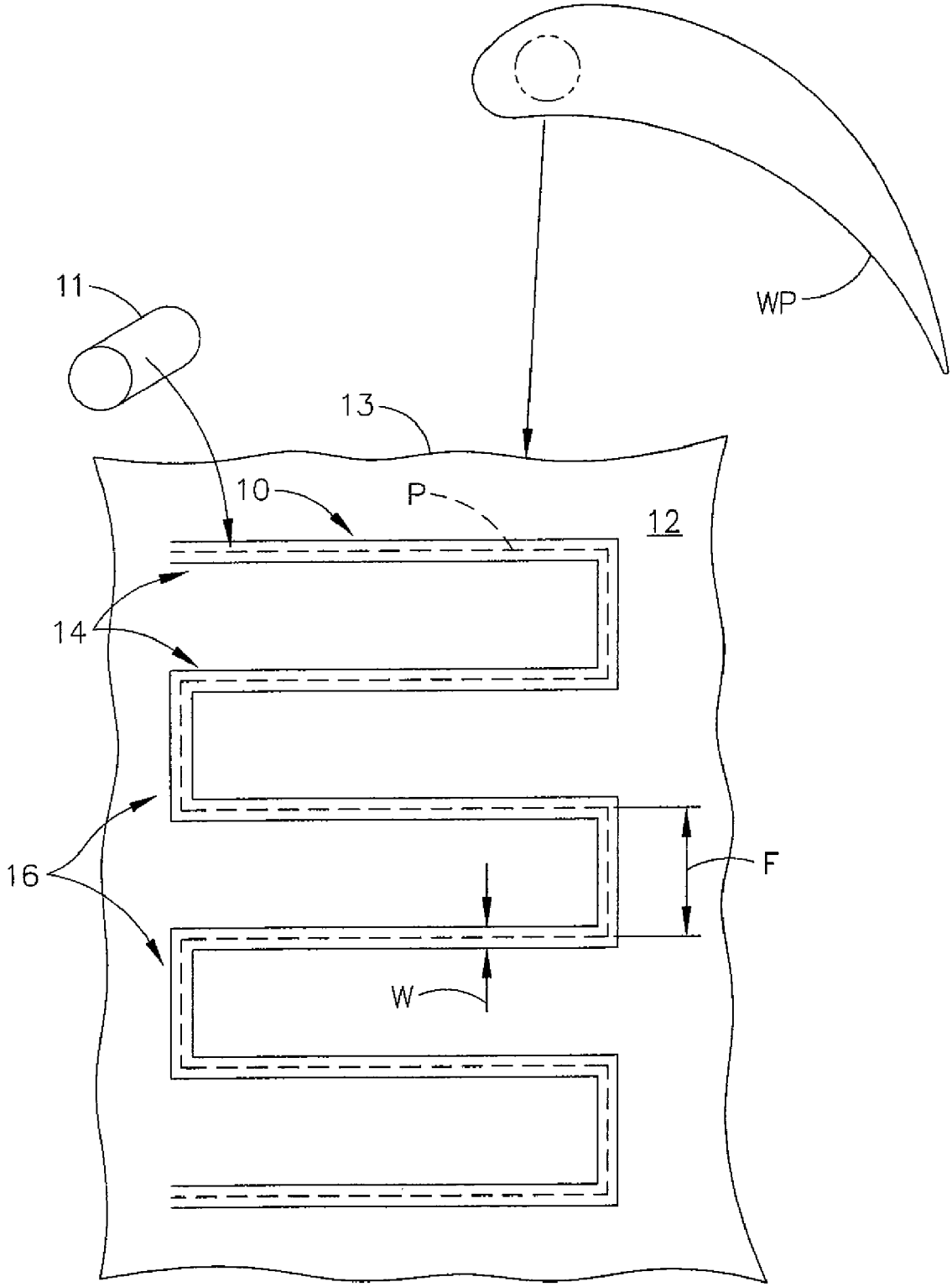
FIG. 1 is a top, schematic view of an application pattern of a burnishing process.

Referring to the drawings wherein identical reference numerals denote the same elements throughout the various views, FIG. 1 illustrates a generalized burnishing pattern 10 overlaid on a surface 12 of a sample 13 of a workpiece "WP" to be treated. Non-limiting examples of workpieces WP that are treated in this manner include compressor blades and stator vanes, fan blades, turbine blades, shafts and rotors, stationary frames, actuator hardware and the like. Such workpieces WP may be made from metal alloys, ceramics, or composite materials (e.g. carbon fiber composites). This burnishing pattern 10 is typically applied using a burnishing apparatus of a known type including a rolling burnishing element 11 which is hydrostatically or mechanically loaded against the surface 12 by a multi-axis numerical-or-computer-controlled manipulator.

As illustrated, the burnishing pattern 10 includes a plurality of segments 14 arranged in a series of S-turns along a path "P" defining the segment centerlines, and connected by lateral segments 16. The segments 14 are separated by a feed distance "F" (also referred to as a "step-over distance" or "offset"), which is the distance between adjacent legs of the centerline path P. Various paths may be used to suit a particular application. For convenience in set-up, programming, and measurement, the path P would most commonly comprise some combination of linear segments or strokes.

The width "W" of the segments 14 (also referred to as a "footprint") is a function of the material and thickness of the workpiece WP, as well as the applied burnishing pressure and dimensions and properties of the burnishing element 11 used. The relationship between the feed distance F and the footprint W determines the degree of overlap between the segments 14. In particular, the overlap value "OV" can be expressed mathematically as a percent by $OV=[(W-F)/W]\times 100$.

Figure 2A:
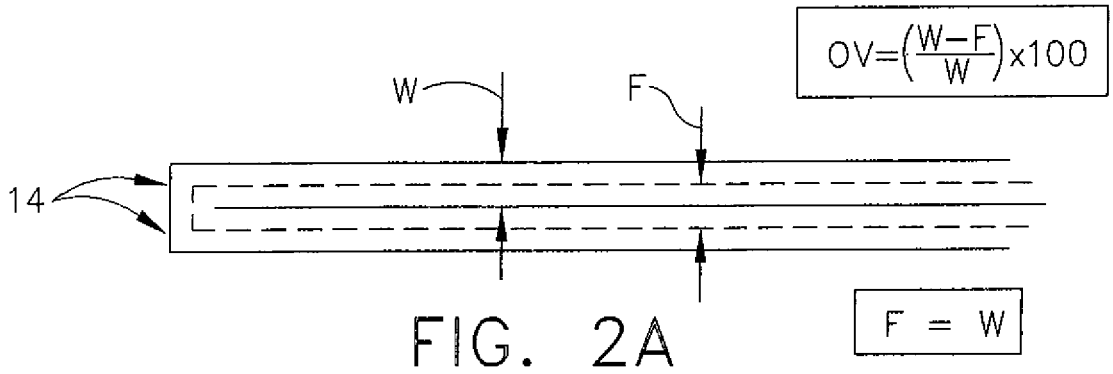
FIG. 2A is a schematic top view of a burnishing path showing a zero overlap condition.
Figure 2B:
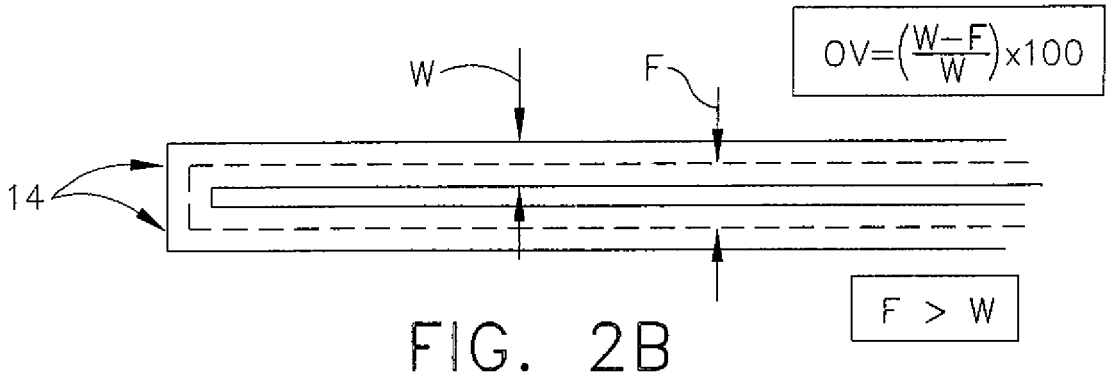
FIG. 2B is a schematic top view of a burnishing path showing a negative overlap condition.
Figure 2C:
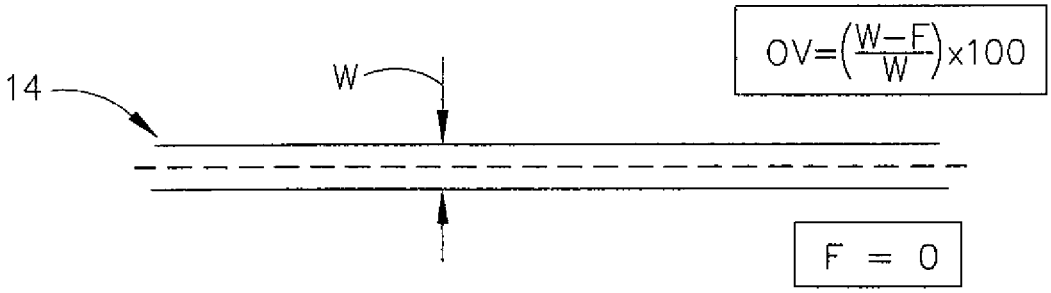
FIG. 2C is a schematic top view of a burnishing path showing a full overlap condition.

If the segments 14 are burnished side-by-side using a feed F equal to the footprint W, they will not overlap each other (FIG. 2A). This is considered to be a 0% overlap value OV and is illustrated in FIG. 2A. If the feed F is higher than the 0% overlap value OV, there will be a space between the adjacent footprints W. This is considered a negative overlap value OV and is illustrated in FIG. 2B. Finally, when the feed F is equal to the footprint W, the segments 14 are essentially burnished one on top of each other, and they are considered to be at 100% overlap value 0V. This is shown in FIG. 2C.

Initial parameters for a burnishing process as follows. First a material sample 13 with a known material composition and thickness is selected. Test segments 14 are burnished on the sample 13 of the workpiece WP and measurements made of the widths of these segments 14 to determine the burnish footprint W at the selected burnishing pressure. This footprint value defines the 0% overlap value OV as described above.

Next, using various defined overlap values, patches are burnished in selected areas of the surface 12 on the sample 13 of the workpiece WP at different overlaps between 0% and 100% overlap value OV, and are measured for hardness. The hardness measurements are then analyzed to determine the desired overlap value OV. The various defined overlap values OV used may be determined arbitrarily, for example by using even increments of overlap, or by using design of experiments (DOE) or other statistical methods. Generally, higher hardness values correspond to greater fatigue resistance and are desired. Once the hardness measurements are made, the overlap value OV corresponding to the desired hardness value (e.g. the highest hardness) is then used as a working overlap value OV to process subsequent workpieces WP.

Example

The parameter setting process described above was applied to flat plates of Ti-6-4 alloy to find the initial process parameters for fatigue testing of gas turbine engine compressor blades. The following general results were observed for Titanium samples 13 with a footprint W of about 0.4178 mm (16.45 mils): Hardness results at about 90% to 100% overlap value OV (high overlap range) were generally lower than at lower overlap settings. High overlap settings also produce greater deformation on the samples 13. This suggests that at high overlap settings the material sample 13 may plastically deform in a macroscopic scale. On the other hand, hardness results at about 50% overlap value OV or lower (low overlap range) generally decline as the overlap setting is reduced. By analyzing the burnishing footprints W and hardness results, the initial pressure and incremental feed F were selected for subsequent burnishing of compressor blades. Testing of the burnished blades showed that fatigue stress resistance of the blades was improved by about 200% of its original value at the test conditions.

This process described above is quick and inexpensive. It allows the use of inexpensive material samples instead of expensive finished products. It also uses inexpensive and quick tests (length measurements and hardness measurements) to narrow down parameter selection before any fatigue testing is performed.

The foregoing has described a method for setting parameters for a burnishing process. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation, the invention being defined by the claims.

What is claimed is:

1. A method of determining parameters for a burnishing operation, comprising:

(a) using a rolling burnishing element to burnish at least two segments on a selected surface area of a material sample, the segments having a common width and overlapping each other by a preselected overlap value;

(b) measuring a resulting hardness of the selected surface area of the material sample; and (c) selecting a working overlap value for a subsequent burnishing operation on a workpiece, based on the measured resulting hardness.

2. The method of claim 1 wherein the common width is determined by:

(a) burnishing a test segment on the selected surface area; and (b) measuring a resulting width of the segment.

3. The method of claim 1 further comprising repeating steps (a) and (b) using a range of overlap values, to generate a plurality of hardness measurements.

4. The method of claim 3 wherein the range of overlap values is from 50% to 90%.

5. The method of claim 3 further comprising selecting the working overlap value corresponding to the highest of the plurality of hardness measurements.

6. The method of claim 3 further comprising correlating each of the measured hardness to a measured fatigue resistance of the material sample.

7. The method of claim 1 further comprising performing a burnishing operation on a workpiece using the selected working overlap value.

* * * * *